US009487865B2

(12) United States Patent
Inatomi et al.

(10) Patent No.: US 9,487,865 B2
(45) Date of Patent: Nov. 8, 2016

(54) PLATING APPARATUS, PLATING METHOD AND STORAGE MEDIUM

(71) Applicant: Tokyo Electron Limited, Tokyo (JP)

(72) Inventors: Yuichiro Inatomi, Nirasaki (JP); Takashi Tanaka, Nirasaki (JP); Mitsuaki Iwashita, Nirasaki (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 205 days.

(21) Appl. No.: 14/360,984

(22) PCT Filed: Nov. 12, 2012

(86) PCT No.: PCT/JP2012/079204
§ 371 (c)(1),
(2) Date: May 28, 2014

(87) PCT Pub. No.: WO2013/080778
PCT Pub. Date: Jun. 6, 2013

(65) Prior Publication Data

US 2014/0356539 A1 Dec. 4, 2014

(30) Foreign Application Priority Data

Nov. 28, 2011 (JP) ..... 2011-259322

(51) Int. Cl.
*C23C 18/16* (2006.01)
*C23C 18/42* (2006.01)
*C23C 18/54* (2006.01)

(52) U.S. Cl.
CPC ..... *C23C 18/1678* (2013.01); *C23C 18/1619* (2013.01); *C23C 18/1628* (2013.01); *C23C 18/1632* (2013.01); *C23C 18/1651* (2013.01); *C23C 18/1682* (2013.01); *C23C 18/42* (2013.01); *C23C 18/54* (2013.01); *C23C 18/1676* (2013.01)

(58) Field of Classification Search
None
See application file for complete search history.

(56) References Cited

U.S. PATENT DOCUMENTS

2007/0117365 A1* 5/2007 Kuriyama ..... C23C 18/1632 438/597
2010/0062159 A1* 3/2010 Tanaka ..... C23C 18/1632 427/256

FOREIGN PATENT DOCUMENTS

JP 2003-129250 A 5/2003
JP 2009-249679 A 10/2009
JP 2010-067837 A 3/2010

OTHER PUBLICATIONS

International Search Report issued in Application No. PCT/JP2012/079204 dated Dec. 18, 2012.

* cited by examiner

*Primary Examiner* — Nathan T Leong
(74) *Attorney, Agent, or Firm* — Pearne & Gordon LLP

(57) ABSTRACT

A plating apparatus 20 includes a substrate holding device 110 configured to hold a substrate W; a discharging device 21 configured to discharge a plating liquid 35 toward the substrate W held by the substrate holding device 110; and a plating liquid supplying device 30 connected to the discharging device 21 and configured to supply the plating liquid 35 to the discharging device 21. A gas supplying device 170 is configured to heat a heating gas G having a higher specific heat capacity than air and supply the heated heating gas G toward the substrate W held by the substrate holding device 110. Further, a controller 160 is configured to control at least the discharging device 21, the plating liquid supplying device 30, and the gas supplying device 170.

7 Claims, 7 Drawing Sheets

PLATING APPARATUS, PLATING METHOD AND STORAGE MEDIUM

CROSS-REFERENCE TO RELATED APPLICATION

This Application is a U.S. national phase application under 35 U.S.C. §371 of PCT Application No. PCT/JP2012/079204 filed on Nov. 12, 2012, which claims the benefit of Japanese Patent Application No. 2011-259322 filed on Nov. 28, 2011, the entire disclosures of which are incorporated herein by reference.

TECHNICAL FIELD

The embodiments described herein pertain generally to a plating apparatus and a plating method for performing a plating process by supplying a plating liquid to a surface of a substrate, and a storage medium therefor.

BACKGROUND

In general, on a substrate such as a semiconductor wafer or a liquid crystal substrate, there is formed a wiring for forming a circuit on a surface thereof. Such a wiring has been made of copper having a low electrical resistance and a high reliability instead of aluminum. However, as compared with aluminum, copper is easily oxidized. As a result, it is required to perform a plating process thereto with a metal having a high electromigration tolerance in order to suppress a surface of a copper wiring from being oxidized.

By way of example, a plating process is performed by supplying an electroless plating liquid to a surface of a substrate on which a copper wiring is formed. Such an electroless plating process is typically performed by a single-substrate processing apparatus (see, for example, Japanese Patent Laid-open Publication No. 2009-249679).

REFERENCES

Patent Document 1: Japanese Patent Laid-open Publication No. 2009-249679

DISCLOSURE OF THE INVENTION

Problems to be Solved by the Invention

However, during a plating process, a temperature of a substrate needs to be controlled. In order to control the temperature of the substrate, a plating liquid heated to a high temperature is supplied to the substrate, and also, rear-surface temperature-controlling water is supplied to a rear surface of the substrate. However, if the rear-surface temperature-controlling water is used, the plating liquid and the rear-surface temperature-controlling water are mixed with each other in a waste liquid generated during and after the plating process. In general, a plating liquid is expensive, so that it is required to separate the plating liquid from the waste liquid and reuse the plating liquid. However, if the plating liquid and the rear-surface temperature-controlling water are mixed with each other in the waste liquid, it may be difficult to separate the plating liquid from the waste liquid and reuse the plating liquid.

In view of the foregoing problems, example embodiments provide a plating apparatus and a plating method capable of efficiently heating a substrate and reusing a plating liquid by suppressing temperature-controlling water from being mixed with the plating liquid to be drained out, and a storage medium therefor.

Means for Solving the Problems

In one example embodiment, a plating apparatus that performs a plating process by supplying a plating liquid to a substrate includes a substrate holding device configured to hold the substrate; a discharging device configured to discharge the plating liquid toward the substrate held by the substrate holding device; a plating liquid supplying device connected to the discharging device and configured to supply the plating liquid to the discharging device; a gas supplying device configured to heat a heating gas having a higher specific heat capacity than air and supply the heated heating gas toward the substrate held by the substrate holding device; and a controller configured to control at least the discharging device, the plating liquid supplying device, and the gas supplying device.

In another example embodiment, a plating method of performing a plating process by supplying a plating liquid to a substrate includes holding the substrate by a substrate holding device; and plating the substrate by discharging the plating liquid from a discharging device toward the substrate held by the substrate holding device. Further, in the plating of the substrate, a heating gas having a higher specific heat capacity than air is heated and supplied toward the substrate held by the substrate holding device.

In yet another example embodiment, a computer-readable storage medium has stored thereon computer-executable instructions that, in response to execution, cause a plating apparatus to perform a plating method. Further, the plating method includes holding a substrate by a substrate holding device; and plating the substrate by discharging a plating liquid from a discharging device toward the substrate held by the substrate holding device. Furthermore, in the plating of the substrate, a heating gas having a higher specific heat capacity than air is heated and supplied toward the substrate held by the substrate holding device.

In accordance with the example embodiments, since a heating gas having a higher specific heat capacity than air is heated and supplied toward a substrate held by a substrate holding device, it is possible to efficiently heat the substrate. Further, temperature-controlling water or the like is suppressed from being mixed with a plating liquid to be drained, so that it is possible to easily reuse the plating liquid.

MODE FOR CARRYING OUT THE INVENTION

Figure 1:
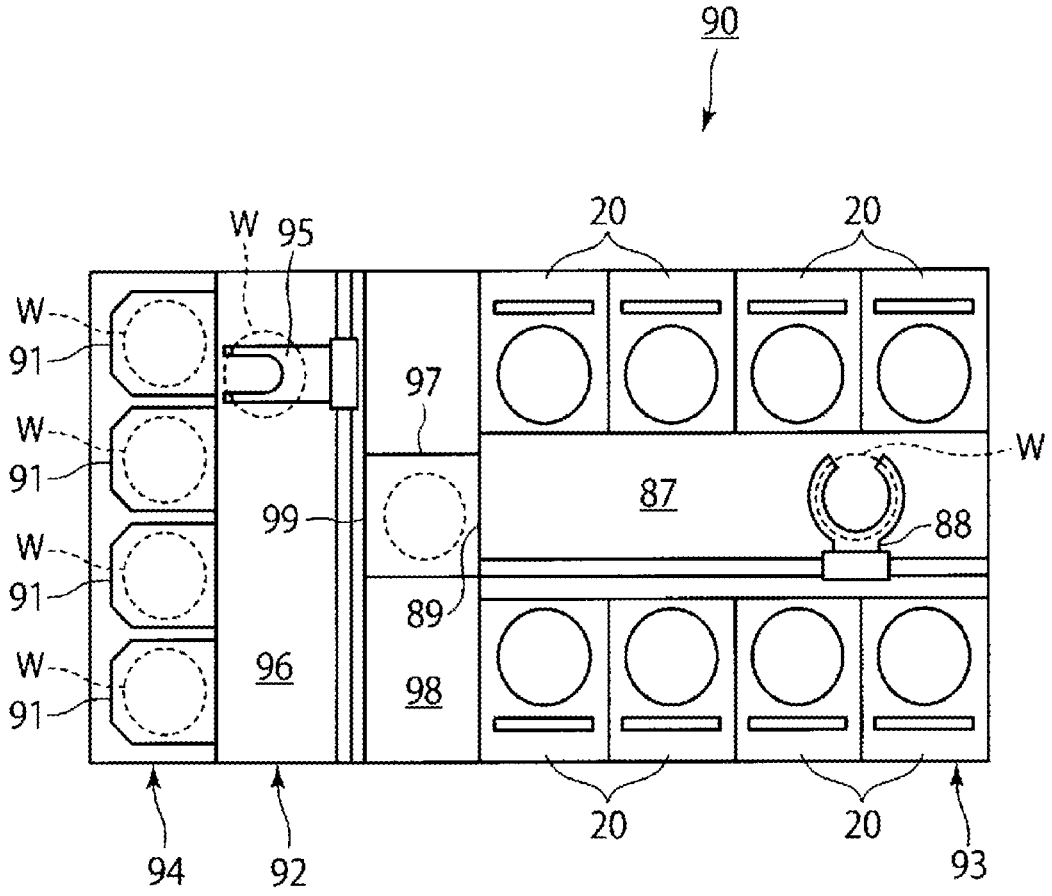
FIG. 1 is a plane view showing an overall configuration of a plating system in accordance with an example embodiment.

Hereinafter, referring to FIG. 1 to FIG. 8, an example embodiment will be explained. Referring to FIG. 1, an overall configuration of a plating system 90 in accordance with the present example embodiment will be explained first.

<Plating System>

As depicted in FIG. 1, the plating system 90 includes a substrate loading/unloading section 92 configured to mount a carrier 91 that accommodates multiple sheets (for example, 25 sheets) of substrates W (herein, semiconductor wafers) and load and unload a preset number of the substrates W; and a substrate processing section 93 configured to perform various processes, such as a plating process or a cleaning process, on the substrate W. The substrate loading/unloading section 92 and the substrate processing section 93 are provided to be adjacent to each other.

(Substrate Loading/Unloading Section)

The substrate loading/unloading section 92 includes a carrier mounting unit 94, a transfer chamber 96 configured to accommodate therein a transfer device 95, and a substrate transit chamber 98 configured to accommodate a substrate transit table 97. In the substrate loading/unloading section 92, the transfer chamber 96 and the substrate transit chamber 98 are connected to and communicate with each other via a transit opening 99. In the carrier mounting unit 94, multiple carriers 91 configured to accommodate the multiple substrates W in a horizontal posture are mounted. In the transfer chamber 96, the substrates W are transferred, and in the substrate transit chamber 98, the substrates W are transited with respect to the substrate processing section 93.

In the substrate loading/unloading section 92, a preset number of the substrates W are transferred each time by the transfer device 95 between one of the carriers 91 mounted on the carrier mounting unit 94 and the substrate transit table 97.

(Substrate Processing Section)

Further, the substrate processing section 93 includes a substrate transfer unit 87 extended in a forward/backward direction (a left/right direction in FIG. 1) at a central portion thereof, and multiple plating apparatuses 20 arranged side by side in the forward/backward direction at two opposite sides of the substrate transfer unit 87 and configured to perform a plating process by supplying a plating liquid to the substrate W.

The substrate transfer unit 87 includes a substrate transfer device 88 configured to be movable in the forward/backward direction. Further, the substrate transfer unit 87 communicates with the substrate transit table 97 in the substrate transit chamber 98 via a substrate loading/unloading opening 89.

In the substrate processing section 93, the substrates W are transferred into each of the plating apparatuses 20 one by one with the substrate transfer device 88 of the substrate transfer unit 87 in the horizontal posture. Further, in each of the plating apparatuses 20, a cleaning process and a plating process are performed on the substrates W one by one.

The respective plating apparatuses 20 have substantially the same configuration except that the respective plating apparatuses 20 use different kinds of plating liquids. Therefore, hereinafter, a configuration of one of the multiple plating apparatuses 20 will be explained.

(Plating Apparatus)

Figure 2:
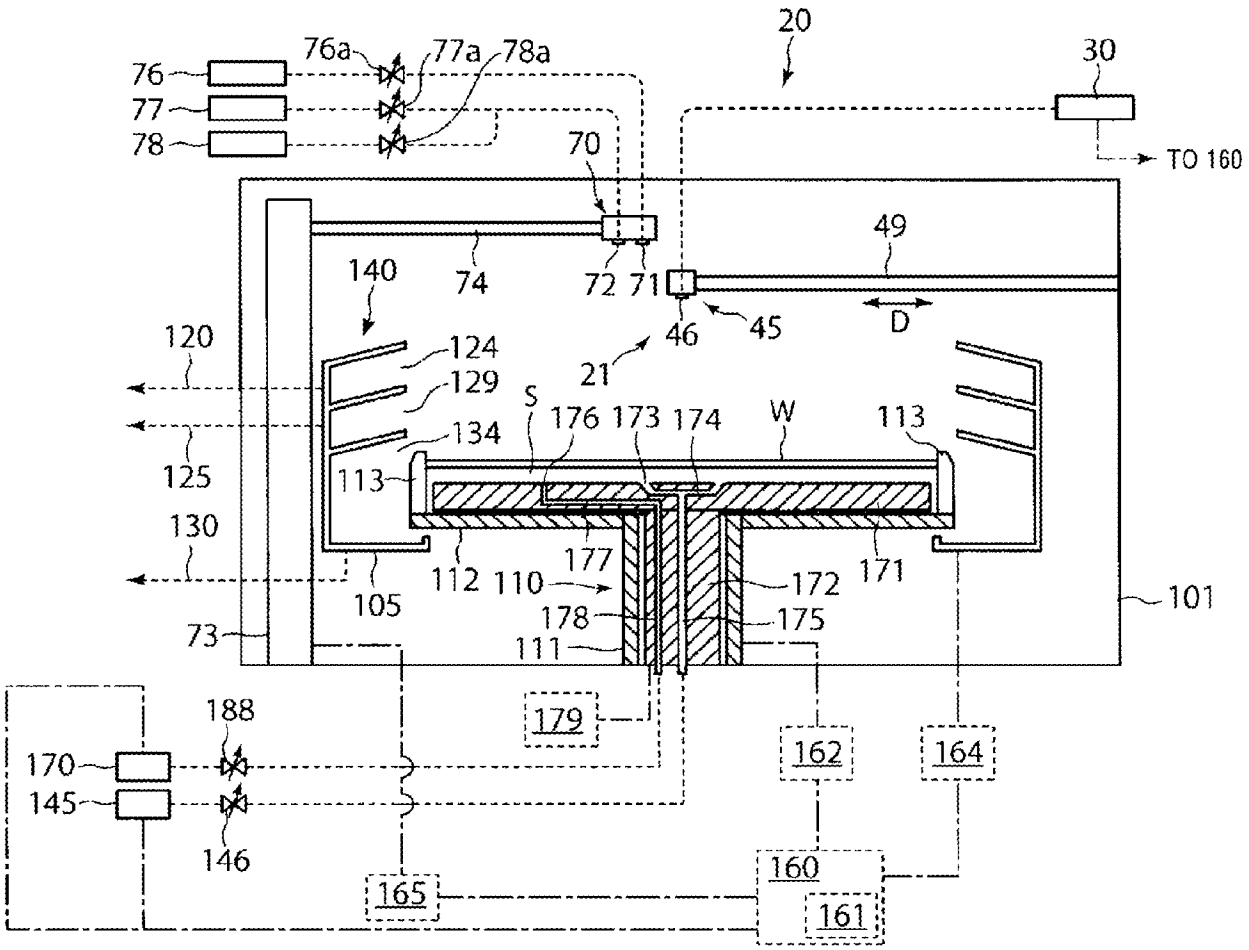
FIG. 2 is a side view showing a plating apparatus in accordance with the example embodiment.

Hereinafter, referring to FIG. 2 and FIG. 3, the plating apparatus 20 will be explained. FIG. 2 is a side view showing the plating apparatus 20, and FIG. 3 is a plane view of the plating apparatus 20.

Figure 3:
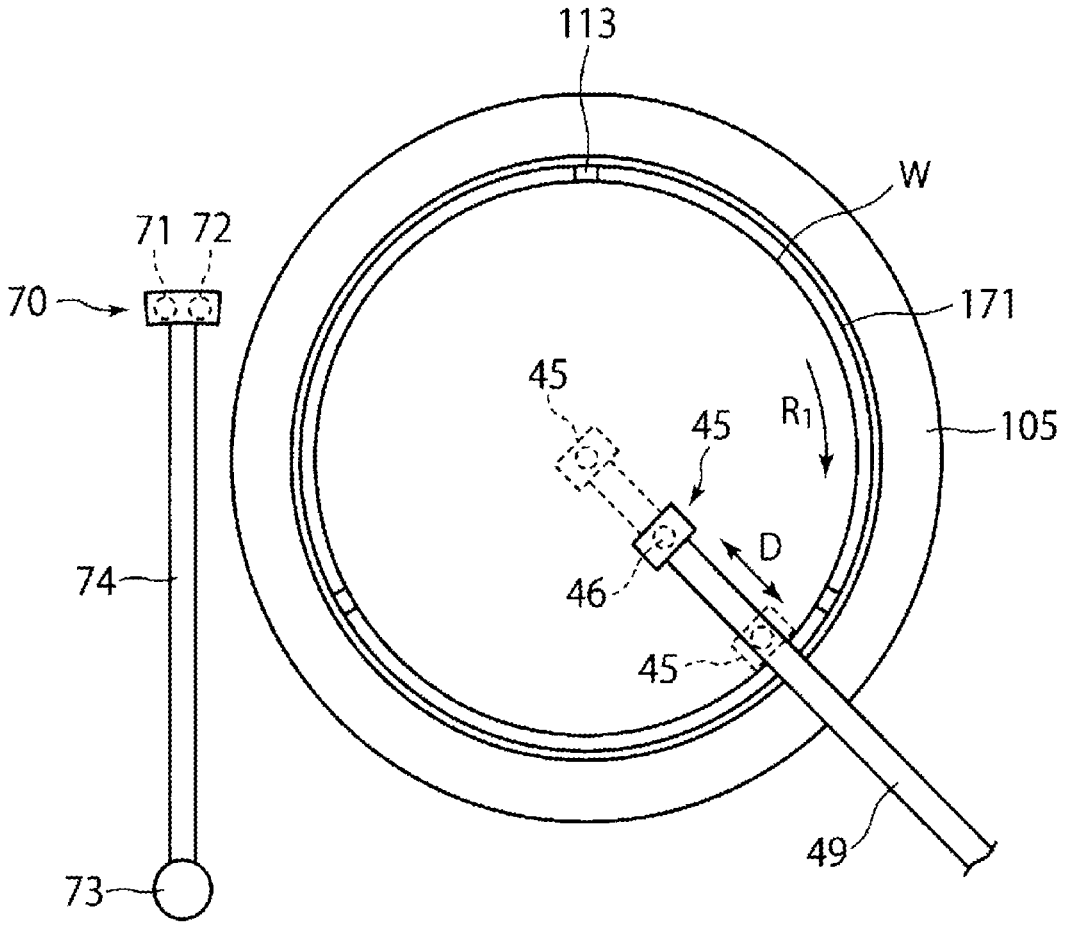
FIG. 3 is a plane view of the plating apparatus illustrated in FIG. 2.

As depicted in FIG. 2 and FIG. 3, the plating apparatus 20 includes a substrate holding device 110 configured to hold and rotate the substrate W within a casing 101; a discharging device 21 configured to discharge a plating liquid toward a surface of the substrate W held by the substrate holding apparatus 110; and a plating liquid supplying device 30 connected to the discharging device 21 and configured to supply the plating liquid to the discharging device 21.

Around the substrate holding device 110, there is provided a liquid draining device 140 configured to drain out the plating liquid dispersed from the substrate W. Further, the substrate holding device 110 is connected to a gas supplying device 170 configured to heat a heating gas G and supply the heated heating gas G toward the substrate W held by the substrate holding device 110. Furthermore, there is provided a controller 160 configured to control the substrate holding device 110, the discharging device 21, the plating liquid supplying device 30, the liquid draining device 140, and the gas supplying device 170.

(Substrate Holding Device)

As depicted in FIG. 2 and FIG. 3, the substrate holding device 110 includes a hollow cylindrical rotation shaft 111 vertically extended within the casing 101; a turntable 112 provided at an upper end of the rotation shaft 111; a wafer chuck 113 provided at an outer periphery of an upper surface of the turntable 112 and configured to support the substrate W; and a rotating device 162 connected to the rotation shaft 111 and configured to rotate the rotation shaft 111.

The rotating device 162 is controlled by the controller 160 and configured to rotate the rotation shaft 111. Thus, the substrate W supported by the wafer chuck 113 is rotated. In this case, the controller 160 is configured to control the rotating device 162, so that the rotation shaft 111 and the wafer chuck 113 can be rotated or stopped. Further, the controller 160 can increase or decrease a rotation number of the rotation shaft 111 and the wafer chuck 113, or can maintain the rotation number thereof at a certain value.

Further, on the turntable 112 as a rear side of the substrate W, there is provided a back plate 171 with a space 5 from the substrate W. The back plate 171 faces the rear surface of the substrate W held by the wafer chuck 113 and is provided between the substrate W held by the wafer chuck 113 and the turntable 112. The back plate 171 is connected and fixed to a shaft 172 penetrating the central portion of the rotation shaft 111. Further, the back plate 171 may include therein a heater. Furthermore, a lower end of the shaft 172 is connected to an elevating device 179 such as an air cylinder. That is, the back plate 171 is configured to be moved up and down between the substrate W held by the wafer chuck 113 and the turntable 112 through the elevating device 179 and the shaft 172.

Within the back plate 171, there is formed a first flow path 174 that communicates with multiple openings 173 formed on a surface of the back plate 171, and the first flow path 174 communicates with a fluid supply path 175 passing through the central portion of the shaft 172. The fluid supply path 175 is connected via a valve 146 to a rear-surface processing liquid supplying device 145 configured to supply a processing liquid to the rear surface of the substrate W.

Further, the back plate 171 includes an opening (supply unit) 176 formed on the surface thereof and a second flow path 177 formed within the back plate 171. The second flow path 177 communicates with the opening 176 and also communicates with a gas supply path 178 vertically passing through the shaft 172. The gas supply path 178 is connected via a valve 188 to the gas supplying device 170 to be described later. That is, the back plate 171 has a function of supplying the heated heating gas G toward the rear surface of the substrate W.

Furthermore, in FIG. 2, the opening 176 of the back plate 171 is formed between the central portion of the back plate 171 and a periphery of the back plate 171 such that a temperature of the substrate W can be uniform on the surface of the substrate W, but may not be limited thereto. The opening 176 of the back plate 171 may be formed at the central portion of the back plate 171 or may be formed at the periphery of the back plate 171.

(Discharging Device)

Hereinafter, the discharging device 21 configured to discharge a plating liquid to the substrate W will be explained. The discharging device 21 includes a first discharge nozzle 45 configured to discharge a plating liquid for chemical reduction plating, such as a CoP plating liquid, toward the substrate W. The plating liquid for the chemical reduction plating is supplied from the plating liquid supplying device 30 to the first discharge nozzle 45. Further, although only the first discharge nozzle 45 is illustrated in FIG. 2, another discharge nozzle (additional discharge nozzle) configured to discharge the plating liquid for the chemical reduction plating, such as a CoP plating liquid, toward the substrate W may be provided together with the first discharge nozzle 45.

Further, as depicted in FIG. 2, the discharging device 21 may further include a second discharge nozzle 70 having a discharge opening 71 and a discharge opening 72. As depicted in FIG. 2 and FIG. 3, the second discharge nozzle 70 is provided at a front end of an arm 74, and the arm 74 is fixed to a supporting shaft 73 that is movable up and down, and is rotated by the rotating device 165.

The discharge opening 71 of the second discharge nozzle 70 is connected via a valve 76*a* to a plating liquid supplying device 76 configured to supply a plating liquid for displacement plating, for example, a Pd plating liquid. Further, the discharge opening 72 is connected via a valve 77*a* to a cleaning liquid supplying device 77 configured to supply a cleaning liquid. Since the second discharge nozzle 70 configured as such is provided, it is possible to perform not only a plating process with the plating liquid for the chemical reduction plating but also a plating process with the plating liquid for the displacement plating, and also possible to perform a cleaning process within the single plating apparatus 20.

Further, as depicted in FIG. 2, the discharge opening 72 of the second discharge nozzle 70 may be further connected via a valve 78*a* to a rinse liquid supplying device 78 configured to supply a pre-treatment liquid, for example, a rinse liquid such as pure water, for performing a pre-treatment before the plating process. In this case, by appropriately controlling the opening/closing of the valve 77*a* and the valve 78*a*, any one of the cleaning liquid and the rinse liquid is selectively discharged to the substrate W through the second discharge nozzle 70.

Hereinafter, the first discharge nozzle 45 will be explained. As depicted in FIG. 2 and FIG. 3, the first discharge nozzle 45 includes a discharge opening 46. Further, the first discharge nozzle 45 is provided at a front end of an arm 49, and the arm 49 is configured to be movable back and forth in a radial direction (a direction indicated by arrows D in FIG. 2 and FIG. 3) of the substrate W. Therefore, the first discharge nozzle 45 can be moved between a central position close to a central portion of the substrate W and a peripheral position outer than the central position.

(Plating Liquid Supplying Device)

Figure 4:
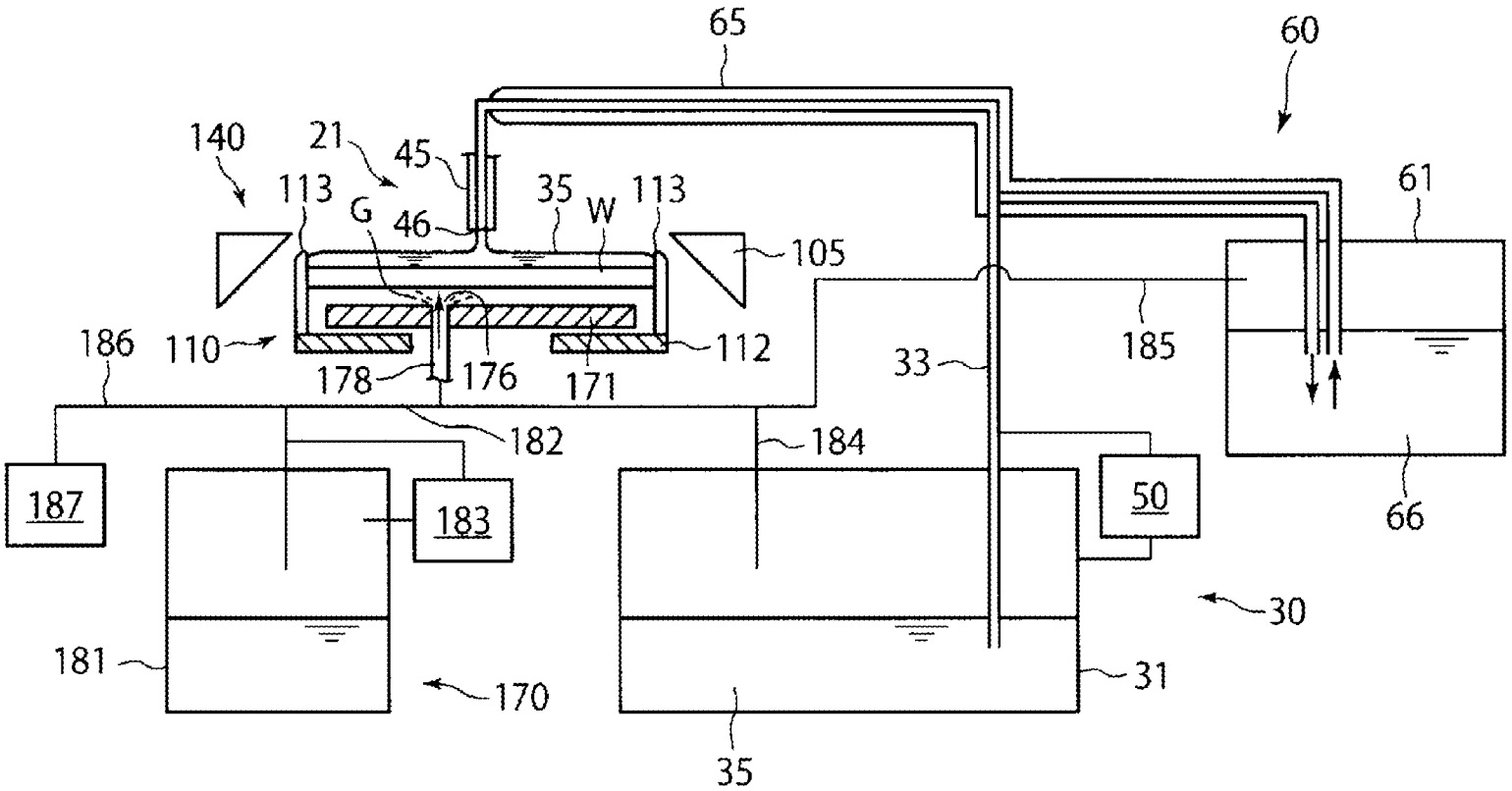
FIG. 4 is a schematic diagram showing flows of a plating liquid and a heating gas in the plating apparatus in accordance with the example embodiment.
Figure 5:
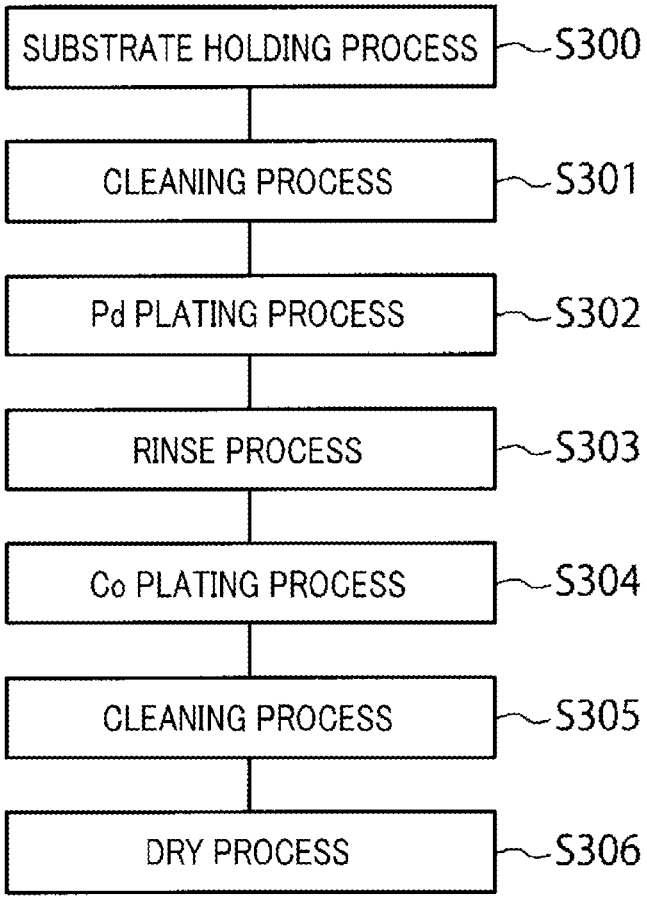
FIG. 5 is a flow chart showing a plating method in accordance with the example embodiment.

Hereinafter, the plating liquid supplying device 30 configured to supply the plating liquid for the chemical reduction plating, such as a CoP plating liquid, to the first discharge nozzle 45 of the discharging device 21 will be explained. FIG. 4 is a schematic diagram showing flows of the plating liquid and the heating gas G in the plating apparatus 20.

As depicted in FIG. 4, the plating liquid supplying device 30 includes a plating liquid supply tank 31 that stores therein a plating liquid 35; and a supply line 33 through which the plating liquid 35 is supplied from the plating liquid supply tank 31 to the first discharge nozzle 45 of the discharging device 21.

Further, as depicted in FIG. 4, the plating liquid supply tank 31 is provided with a tank heating unit 50 configured to heat the plating liquid 35 to a storage temperature. Further, at a portion of the supply line 33 between the tank heating unit 50 and the first discharge nozzle 45, there is provided a heating unit 60 configured to heat the plating liquid 35 to be supplied toward the first discharge nozzle 45 of the discharging device 21 and control a temperature of the plating liquid 35 to be a discharge temperature higher than the storage temperature.

Various kinds of chemical liquids are supplied into the plating liquid supply tank 31 from multiple chemical liquid supplying sources (not illustrated) in which various kinds of components of the plating liquid 35 are stored. By way of example, chemical liquids such as a $CoSO_4$ metal salt containing Co ions, a reducing agent (for example, hypophosphorous acid or the like), ammonia, and additives are supplied. In this case, flow rates of the various kinds of the chemical liquids are controlled such that the components of the plating liquid 35 to be stored within the plating liquid supply tank 31 are appropriately adjusted.

Furthermore, as depicted in FIG. 4, the heating unit 60 is configured to further heat the plating liquid 35 heated to the storage temperate by the tank heating unit 50 to the discharge temperature. The heating unit 60 includes a temperature medium supplying unit 61 configured to heat a heat transfer medium 66, e.g., temperature controlling water, to the discharge temperature or a temperature higher than the discharge temperature; and a temperature controlling pipe 65 provided at the supply line 33 and configured to control a temperature of the plating liquid 35 by transferring heat of the heat transfer medium 66 from the temperature medium supplying unit 61 to the plating liquid 35 within the supply line 33.

(Gas Supplying Device)

As described above, the gas supplying device 170 is configured to heat the heating gas G having a higher specific heat capacity than air and supply the heated heating gas G toward the substrate W held by the substrate holding device 110. As depicted in FIG. 4, the gas supplying device 170 includes a gas supply tank 181 that stores the heating gas G; and a gas supply line 182 configured to supply the heating gas G stored in the gas supply tank 181 to the gas supply path 178. The gas supply tank 181 is connected to a gas temperature controlling unit 183 configured to heat the heating gas G and control a temperature thereof, so that the heating gas G can be heated to a preset temperature.

The heating gas G has a higher specific heat capacity than air (specific heat capacity: 1.0 (J/g·K)), and specifically, includes, for example, steam (specific heat capacity: 2.1

(J/g·K)) and helium (specific heat capacity: 5.2 (J/g·K)). It is desirable to use the steam in terms of cost.

If the steam is used as the heating gas G, the heating gas G to be supplied to the gas supply path 178 is not necessarily limited to being supplied from the gas supply tank 181. As depicted in FIG. 4, the gas supply path 178 may be connected to the temperature medium supplying unit 61 of the heating unit 60 via a gas supply line 185, and steam in a gas phase within the temperature medium supplying unit 61 may be supplied to the gas supply path 178. Further, the gas supply path 178 may be connected to the plating liquid supply tank 31 of the plating liquid supplying device 30 via a gas supply line 184, and steam in a gas phase within the plating liquid supply tank 31 may be supplied as the heating gas G to the gas supply path 178. In this case, one or two of the steams from the temperature medium supplying unit 61, the steam from the plating liquid supply tank 31, and the steam from the gas supply tank 181 may be used, or all of them may be used together.

Further, as depicted in FIG. 4, an additional gas supplying unit 187 may be provided, and the additional gas supplying unit 187 may be connected to the gas supply path 178 of the gas supplying device 170 via a gas supply line 186. In this case, the additional gas supplying unit 187 may supply a gas containing at least one (for example, ammonia) of components contained in the plating liquid 35 to the heating gas G in the gas supply path 178, and may supply the mixed gas to the substrate W. Further, a component (for example, ammonia) of the plating liquid 35 in a gas phase within the plating liquid supply tank 31 may be supplied to the heating gas G in the gas supply path 178 through the gas supply line 184 and the mixed gas may be supplied to the substrate W. Further, in this case, the component from the additional gas supplying unit 187 may be used alone, the component from the plating liquid supply tank 31 may be used alone, or the component from the additional gas supplying unit 187 and the component from the plating liquid supply tank 31 may be used together. By supplying the components of the plating liquid 35 to the substrate W as such, it is possible to suppress the components from being volatilized from the plating liquid 35 during the plating process, or possible to supplement the plating liquid 35 with the components contained in the heating gas G equivalent to the components volatilized from the plating liquid 35 during the plating process.

(Liquid Draining Device)

Hereinafter, the liquid draining device 140 configured to drain out a plating liquid or a cleaning liquid dispersed from the substrate W will be explained with reference to FIG. 2.

The liquid draining device 140 includes a cup 105, which is provided around the substrate holding device 110 and has draining openings 124, 129, and 134; an elevating device 164 connected to the cup 105 and configured to vertically move up and down the cup 105; and liquid draining paths 120, 125, and 130 connected to the cup 105 and configured to collect and drain out a plating liquid dispersed from the substrate W at each of the draining openings 124, 129, and 134.

In this case, processing liquids dispersed from the substrate W are drained out from the liquid draining paths 120, 125, and 130 through the draining openings 124, 129, and 134 depending on kinds of the processing liquids. By way of example, a CoP plating liquid dispersed from the substrate W is drained out from the plating liquid draining path 120, a Pd plating liquid dispersed from the substrate W is drained out from the plating liquid draining path 125, and a cleaning liquid and a rinse liquid dispersed from the substrate W are drained out from the processing liquid draining path 130. The CoP plating liquid and the Pd plating liquid drained out as described above may be separately collected and reused.

An operation of the plating system 90 including the multiple plating apparatuses 20 configured as described above is controlled by the controller 160 according to various programs recorded in a storage medium 161 provided in the controller 160. Thus, various processes are performed on the substrate W. Herein, the storage medium 161 is configured to store various setting data or various programs such as a plating program to be described later. As the storage medium 161, a well-known storage medium such as a computer-readable memory, e.g., a ROM or a RAM, or a hard disc, or disc-type storage medium such as a CD-ROM, a DVD-ROM, or a flexible disc may be used.

<Plating Method>

In the present example embodiment, operations of the plating system 90 and the plating apparatus 20 are controlled according to the plating program stored in the storage medium 161 such that a plating process is performed on the substrate W. Hereinafter, referring to FIG. 5, there will be explained a method of performing a Pd plating process on the substrate W by the displacement plating and then performing a Co plating process by the chemical reduction plating within a single plating apparatus 20.

(Substrate Holding Process)

The single substrate W is loaded into the single plating apparatus 20 from the substrate transit chamber 98 by the substrate transfer device 88 of the substrate transfer unit 87.

In the plating apparatus 20, the cup 105 is moved down to a preset position and then, the loaded substrate W is held by the wafer chuck 113 of the substrate holding device 110 (substrate holding process S300). Thereafter, the cup 105 is moved up by the elevating device 164 to a position where the draining opening 134 of the liquid draining device 140 faces an outer periphery of the substrate W.

(Cleaning Process)

Then, a cleaning process S301 including a rinse process, a pre-cleaning process, and another rinse process is performed. The valve 78*a* of the rinse liquid supplying device 78 is opened, and a rinse liquid is supplied to a surface of the substrate W through the discharge opening 72 of the second discharge nozzle 70.

Thereafter, the pre-cleaning process is performed. The valve 77*a* of the cleaning liquid supplying device 77 is opened, and a cleaning liquid is supplied to the surface of the substrate W through the discharge opening 72 of the second discharge nozzle 70. By way of example, malic acid may be used as the cleaning liquid, and pure water may be used as the rinse liquid. Then, in the same manner as described above, the rinse liquid is supplied to the surface of the substrate W through the discharge opening 72 of the second discharge nozzle 70. The rinse liquid or the cleaning liquid used in performing the process is disposed of from the processing liquid draining path 130 through the draining opening 134 of the cup 105. Further, in the cleaning process S301 and all of the following processes, the substrate W is being rotated in a first rotation direction R1 (FIG. 3) by the substrate holding device 110 unless specifically stated otherwise.

(Pd Plating Process)

Then, a Pd plating process S302 is performed. The Pd plating process S302 is performed as the displacement plating process on the substrate W which is not dried after the cleaning process. By performing the displacement plating process while the substrate W is not dried, it is possible to avoid a case where the displacement plating is not effectively performed since copper or the like on a plating target surface of the substrate W is oxidized.

In the Pd plating process, the cup 105 is moved down by the elevating device 164 to a position where the draining opening 129 of the liquid draining device 140 faces the outer periphery of the substrate W. Then, the valve 76*a* of the plating liquid supplying device 76 is opened, and a plating liquid containing Pd is discharged to the surface of the substrate W through the discharge opening 71 of the second discharge nozzle 70 at a desired flow rate. As such, the Pd plating process is performed on the surface of the substrate W. The plating liquid used in the Pd plating process is drained out through the draining opening 129 of the cup 105. The plating liquid drained out through the draining opening 129 is collected to be reused or disposed of from the liquid draining path 125.

(Rinse Process)

Then, as a pre-treatment performed before a Co plating process, for example, a rinse process S303 is performed. During the rinse process S303, for example, a rinse liquid as a pre-treatment liquid is supplied to the surface of the substrate W. Further, after the rinse process, the substrate W is cleaned by using a chemical liquid. Thereafter, a rinse process may be performed with a rinse liquid in order to clean the chemical liquid.

(Co Plating Process)

Then, a Co plating process S304 is performed in the same plating apparatus 20 as used in performing the above-described processes S301 to S303. The Co plating process S304 is performed as the chemical reduction plating process.

In the Co plating process S304, the controller 160 controls the substrate holding device 110, so that the substrate W held by the substrate holding device 110 is rotated. In this state, the plating liquid 35 heated to the discharge temperature by the heating unit 60 is discharged toward the surface of the substrate W through the discharge opening 46 of the first discharge nozzle 45.

By discharging the plating liquid 35 toward the substrate W from the first discharge nozzle 45, a Co plating layer is formed on a Pd plating layer on the substrate W. When the Co plating layer is formed to have a preset thickness, for example, 1 μm, the discharging of the plating liquid 35 from the first discharge nozzle 45 is stopped, and the Co plating process S304 is completed. A time required for the Co plating process S304 may be, for example, about 20 minutes to about 40 minutes.

Further, in the Co plating process S304, it is not necessary to continuously rotate the substrate W at a constant rotation number. The rotation number may be temporarily increased or decreased, or the rotation may be temporarily stopped. Further, in the Co plating process S304, the first discharge nozzle 45 may horizontally move (scan) from the central portion of the substrate W toward the peripheral portion of the substrate W.

Furthermore, in the Co plating process S304, the cup 105 is moved down by the elevating device 164 to a position where the draining opening 124 faces the outer periphery of the substrate W. Therefore, the plating liquid 35 used in the Co plating process is drained out through the draining opening 124 of the cup 105. The drained out plating liquid 35 after the process may be collected to be reused from the liquid draining path 120.

Meanwhile, in the present example embodiment, during the Co plating process S304, the controller 160 controls the gas supplying device 170 to supply the heated heating gas G (for example, steam) toward the rear surface of the substrate W at substantially the same time when the plating liquid 35 is discharged through the discharge opening 46 of the first discharge nozzle 45. That is, the gas supplying device 170 supplies the heating gas G, which is stored in the gas supply tank 181 and heated by the gas temperature controlling unit 183, toward the rear surface of the substrate W from the opening 176 of the back plate 171 via the gas supply line 182, the gas supply path 178 and the second flow path 177 in sequence. Otherwise, the gas supplying device 170 supplies the heating gas G from the plating liquid supply tank 31 or the temperature medium supplying unit 61 toward the rear surface of the substrate W through the opening 176 of the back plate 171.

The heating gas G from the gas supplying device 170 is continuously supplied while the plating liquid 35 is discharged through the first discharge nozzle 45. During this period, the heating gas G stays at the space S between the substrate W and the back plate 171 and continuously heats the substrate W. Further, the heating gas G heats the plating liquid 35 via the substrate W. In the present example embodiment, a gas, for example, steam, having a higher specific heat capacity than air is used as the heating gas G, so that the substrate W can be efficiently heated. Thereafter, when the discharge of the plating liquid 35 from the first discharge nozzle 45 is stopped, the supply of the heating gas G from the gas supplying device 170 is stopped. Otherwise, before or after the discharge of the plating liquid 35 from the first discharge nozzle 45 is stopped, the supply of the heating gas G by the gas supplying device 170 may be stopped.

By supplying the heated heating gas G toward the rear surface of the substrate W through the opening 176 of the back plate 171 as such, it is possible to control a temperature of the substrate W. Further, it is possible to suppress the temperature of the plating liquid from being decreased. Thus, the plating process can be performed while a temperature is maintained at a constant value (for example, about 60° C. to about 90° C.), so that the Co plating layer can be uniformly grown on the surface of the substrate W. Furthermore, since the heating gas G to be supplied toward the substrate W is supplied in the gas phase, it is possible to suppress the plating liquid 35 drained out from the draining opening 124 of the cup 105 from being mixed with water for heating. Therefore, the drained plating liquid 35 after the process can be easily reused. In particular, in the Co plating process S304, a time required for the plating process may be, for example, about 20 minutes to about 40 minutes. Therefore, by reusing the plating liquid 35, it is possible to reduce an amount of a waste liquid with more efficiency.

Further, as described above, the heating gas G may contain at least one (for example, ammonia) of the components contained in the plating liquid 35. In this case, it is possible to suppress the components from being volatilized from the plating liquid 35 during the plating process, or possible to supplement the plating liquid 35 with the components contained in the heating gas G equivalent to the components volatilized from the plating liquid 35 during the plating process.

(Cleaning Process)

Then, a cleaning process S305 including a rinse process, a post-cleaning process, and another rinse process is performed on the surface of the substrate W on which the Co plating process has been performed. The cleaning process S305 is performed in the substantially same manner as the above-described cleaning process S301. Accordingly, detailed explanation thereof will be omitted.

(Dry Process)

Thereafter, a dry process S306 of drying the substrate W is performed. By way of example, by rotating the turntable 112, a liquid adhering to the substrate W is dispersed outward by a centrifugal force, so that the substrate W is dried. That is, the turntable 112 may serve as a drying device configured to dry the surface of the substrate W.

As such, within the single plating apparatus 20, the Pd plating process is performed first on the surface of the substrate W by the displacement plating and then, the Co plating process is performed by the chemical reduction plating.

Then, the substrate W may be transferred to another plating apparatus 20 for Au plating process. In this case, within the another plating apparatus 20, an Au plating process is performed on the surface of the substrate W by the displacement plating. An Au plating process is substantially the same as the above-described the Pd plating process except that different plating liquid and cleaning liquid are used. Thus, detailed explanation thereof will be omitted.

Effect of Present Example Embodiment

As described above, in accordance with the present example embodiment, since the heating gas (for example, steam) having a higher specific heat capacity than air is heated and supplied toward the substrate W held by the substrate holding device 110, the substrate W can be efficiently heated and the plating layer made of the plating liquid 35 can be uniformly grown on the surface of the substrate W. Further, it is possible to suppress a plating liquid drained out from the liquid draining device 140 from being mixed with water or the like. Therefore, the discharged plating liquid can be easily reused.

Modification Example

Hereinafter, modification examples of the present example embodiment will be explained.

In the above-described example embodiment, there has been explained the case where the heated heating gas G (for example, steam) is supplied toward the rear surface of the substrate W at substantially the same time when the plating liquid 35 is discharged from the discharge opening 46 of the first discharge nozzle 45 during the Co plating process S304. However, the example embodiment is not limited thereto. During the Co plating process S304, before the plating liquid 35 is discharged from the discharge opening 46 of the first discharge nozzle 45, the heating gas G (for example, steam) may be supplied toward the rear surface of the substrate W.

In this case, the additional gas supplying unit 187 (FIG. 4) may supply an inert gas (for example, nitrogen) into the heating gas G in the gas supply path 178. As such, by mixing the heating gas G with the inert gas (for example, nitrogen) and supplying the mixed gas toward the substrate W, it is possible to suppress the substrate W before the plating liquid 35 is supplied from being oxidized with the heating gas G.

Figure 6:
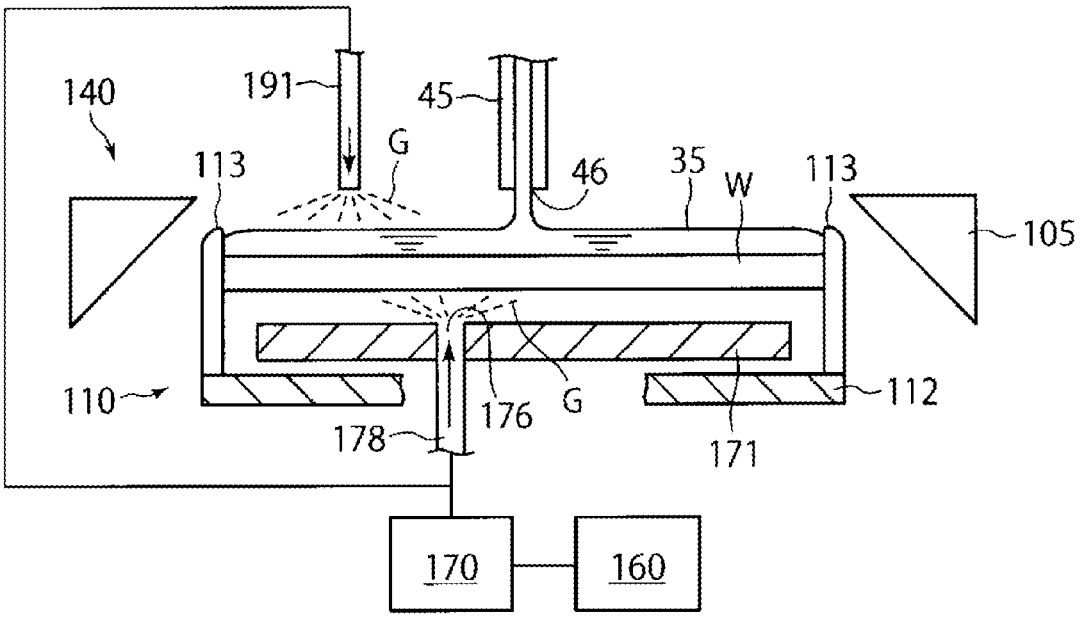
FIG. 6 is a schematic diagram showing a modification example of the plating apparatus.

Further, in the above-described example embodiment, there has been explained the case where the heating gas G is supplied toward the rear surface of the substrate W. However, the example embodiment is not limited thereto. The heating gas G may also be supplied from a front surface side of the substrate W. That is, as depicted in FIG. 6, a gas nozzle 191 is provided around the first discharge nozzle 45 as the front surface side of the substrate W, and the heating gas G may be supplied not only to the rear surface of the substrate W but also to the front surface of the substrate W. In this case, the gas nozzle 191 is connected to the gas supplying device 170, and the controller 160 controls the gas supplying device 170 to supply the heating gas G to the front surface of the substrate W via the gas nozzle 191. With this configuration, it is possible to suppress the temperature decrease of the plating liquid 35 on the front surface of the substrate W, so that a plating layer can be uniformly grown on the front surface of the substrate W.

Figure 7:
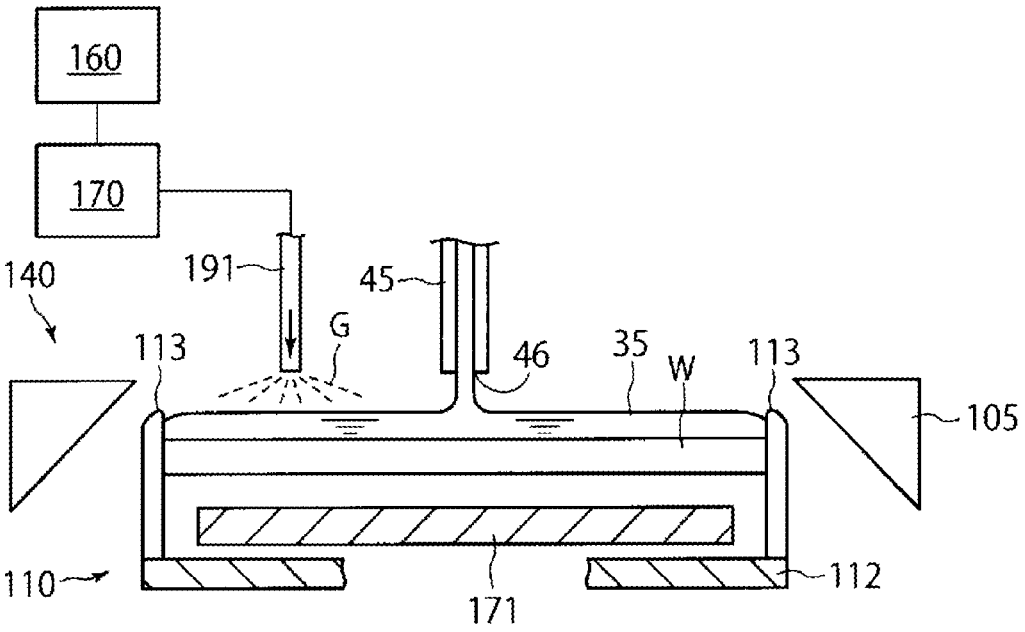
FIG. 7 is a schematic diagram showing another modification example of the plating apparatus.

Otherwise, as depicted in FIG. 7, the heating gas G may be supplied only from the front surface side of the substrate W from the gas nozzle 191 and the heating gas G may not be supplied to the rear surface side of the substrate W. Even in this case, it is possible to control the temperature of the plating liquid on the front surface of the substrate W, so that a plating layer can be uniformly grown on the front surface of the substrate W.

Figure 8:
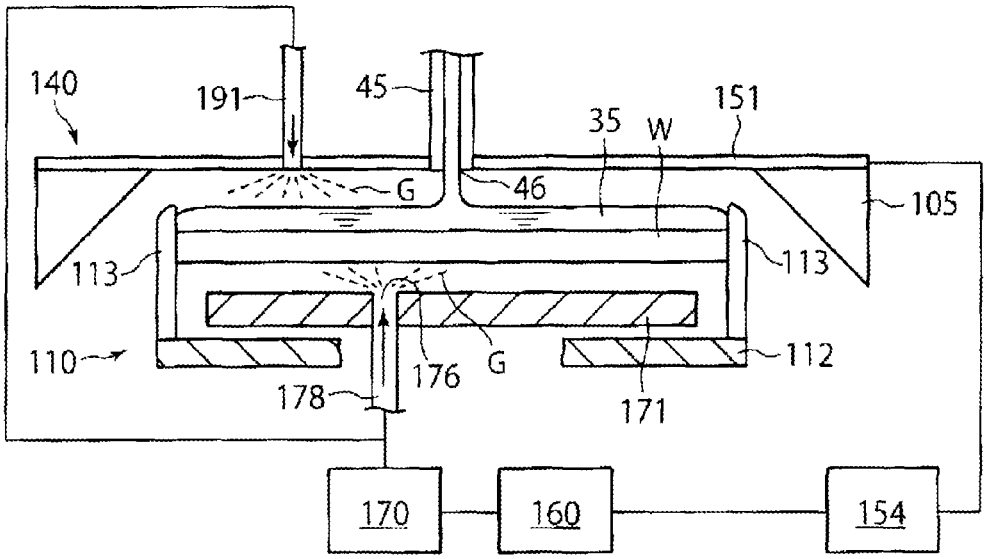
FIG. 8 is a schematic diagram showing still another modification example of the plating apparatus.

Further, as depicted in FIG. 8, a top plate 151 may be provided above the substrate W to be separated from the substrate W. In this case, the top plate 151 is provided on an upper surface of the cup 105 to substantially cover the entire surface of the substrate W. Further, in the top plate 151, openings are formed at positions corresponding to the discharge opening 46 of the first discharge nozzle 45 and the gas nozzle 191, respectively. As a result, the plating liquid from the discharge opening 46 and the heating gas G from the gas nozzle 191 are supplied without interruption.

Further, the top plate 151 is connected to the elevating device 154 and controlled by the controller 160, so that the top plate 151 can be moved up and down together with the cup 105. Furthermore, the top plate 151 may be moved up and down by the elevating device 154 independently of the cup 105. Thus, in the above-described substrate holding process S300, the substrate W can be loaded and unloaded with respect to the substrate holding device 110.

Since the top plate 151 that covers the entire surface of the substrate W is provided above the substrate W as such, the heating gas G supplied from the opening 176 of the back plate 171 and the gas nozzle 191 or a gas (for example, steam) generated from the plating liquid 35 stays in a space between the substrate W and the top plate 151. Thus, it is possible to heat the substrate W and the plating liquid 35 with more efficiency, and it becomes clear that a plating layer can be uniformly grown on the surface of the substrate W.

Further, in FIG. 8, the heating gas G may be supplied to only the rear surface of the substrate W through the opening 176 of the back plate 171 without the gas nozzle 191 in the same manner as the example embodiment illustrated in FIG. 4. Otherwise, the heating gas G may be supplied to only the front surface of the substrate W from the gas nozzle 191 without forming the opening 176 of the back plate 171 in the same manner as the example embodiment illustrated in FIG. 7.

Further, in FIG. 6 to FIG. 8, a component (for example, ammonia) contained in the plating liquid 35 and/or an inert gas (for example, nitrogen) may be mixed with the heating gas G supplied from the gas nozzle 191 by providing the additional gas supplying unit 187 (FIG. 4) in the same manner as the above-described example embodiment.

Furthermore, in the case illustrated in FIG. 6 to FIG. 8, during the Co plating process S304, the timing for supplying the heating gas G to the front surface side of the substrate W from the gas nozzle 191 need not be the approximately same as the timing for discharging the plating liquid 35 from the discharge opening 46 of the first discharge nozzle 45. As long as the temperature decrease of the plating liquid 35 on the surface of the substrate W can be suppressed, the heating gas G may be supplied toward the front surface of the substrate W from the gas nozzle 191 after the plating liquid 35 is discharged through the discharge opening 46 of the first discharge nozzle 45.

Moreover, in FIG. 6 to FIG. 8, the same parts as shown in the example embodiment illustrated in FIG. 1 to FIG. 4 are assigned the same reference numerals, and, thus, detailed explanation thereof will be omitted.

Further, in the example embodiments, there has been illustrated the case where the substrate W is rotated and held by the substrate holding device 110. However, the example embodiments are not limited thereto. That is, the substrate holding device 110 may not rotate the substrate W. In this case, the substrate holding device 110 holds the substrate W such that the substrate W is not rotated, and the plating liquid supplying device 30 may include a long nozzle of which opening is extended in one direction (not illustrated). In this case, the long nozzle may scan over the substrate W, so that the plating liquid 35 may be supplied to the substrate W.

Further, in the above-described example embodiments, there has been explained the case where the CoP plating liquid is used as the plating liquid 35 for the chemical reduction plating to be discharged from the first discharge nozzle 45 toward the substrate W. However, the plating liquid 35 to be used is not limited to the CoP plating liquid and various plating liquids 35 may be used. By way of example, various plating liquids 35 such as a CoWB plating liquid, a CoWP plating liquid, a CoB plating liquid, or a NiP plating liquid may be used as the plating liquid 35 for the chemical reduction plating.

We claim:

1. A plating method of performing a plating process by supplying a plating liquid to a substrate, the plating method comprising:

holding the substrate by a substrate holding device; and plating the substrate by discharging the plating liquid from a discharging device toward the substrate held by the substrate holding device, wherein, in the plating of the substrate, a heating gas having a higher specific heat capacity than air is heated and supplied toward the substrate held by the substrate holding device, and wherein, at least one of components contained in the plating liquid exists in a gas phase within a plating liquid supply tank configured to store therein the plating liquid, such that both the plating liquid in a liquid phase and the at least one components in the gas phase are stored in the plating liquid supply tank, a gas of the at least one of components contained in the plating liquid within the plating liquid supply tank is supplied into the heating gas, and a mixed gas including the heating gas and the gas of the at least one of components contained in the plating liquid is supplied toward the substrate.

2. The plating method of claim 1, wherein the heating gas is formed of steam.

3. The plating method of claim 1, wherein the heating gas is supplied toward a rear surface of the substrate.

4. The plating method of claim 1, wherein the heating gas is supplied toward a front surface of the substrate.

5. The plating method of claim 1, wherein, in the plating of the substrate, the heating gas is supplied toward the substrate at the substantially same time when the plating liquid is discharged from the discharging device.

6. The plating method of claim 1, wherein, in the plating of the substrate, the heating gas is supplied toward the substrate before the plating liquid is discharged from the discharging device.

7. The plating method of claim 6, wherein, in the plating of the substrate, an inert gas is supplied into the heating gas, and a mixed gas including the heating gas and the inert gas is supplied toward the substrate.

* * * * *